US007183714B1

(12) United States Patent
Choudhury

(10) Patent No.: US 7,183,714 B1
(45) Date of Patent: Feb. 27, 2007

(54) BALLAST WITH RELAMPING CIRCUITRY

(75) Inventor: Ayan Kumar Choudhury, Haryana (IN)

(73) Assignee: Osram Sylvania, Inc., Danvers, MA (US)

( * ) Notice: Subject to any disclaimer, the term of this patent is extended or adjusted under 35 U.S.C. 154(b) by 35 days.

(21) Appl. No.: 11/172,066

(22) Filed: Jun. 30, 2005

(51) Int. Cl.
*H05B 39/00* (2006.01)
*H05B 37/02* (2006.01)

(52) U.S. Cl. ..... 315/97; 315/105; 315/224; 315/276; 315/308; 315/309

(58) Field of Classification Search ..... 315/95, 315/97, 105, 224, 225, 226, 246, 276, 283, 315/291, 307, 308, 309
See application file for complete search history.

(56) References Cited

U.S. PATENT DOCUMENTS 5,142,202 A * 8/1992 Sun et al. ..... 315/225
5,262,699 A * 11/1993 Sun et al. ..... 315/209 R
5,436,529 A * 7/1995 Bobel ..... 315/127
5,461,287 A * 10/1995 Russell et al. ..... 315/209 R
5,495,149 A * 2/1996 Hiramatsu et al. ..... 315/209 R
5,635,799 A * 6/1997 Hesterman ..... 315/127
5,650,694 A * 7/1997 Jayaraman et al. ..... 315/225
5,751,115 A * 5/1998 Jayaraman et al. ..... 315/225
5,770,925 A 6/1998 Konopka et al. ..... 315/225
5,883,473 A 3/1999 Li et al. ..... 315/225

* cited by examiner

*Primary Examiner*—Thuy Vinh Tran
(74) *Attorney, Agent, or Firm*—Fitch, Even, Tabin & Flannery

(57) ABSTRACT

An apparatus for detecting the reconnection of a lamp filament to an electronic ballast driving a fluorescent lamp. A control circuit controls an inverter circuit to providing power to a filament control circuit. The filament control circuit preheats and powers the lamp filament of the one or more lamps. A pulse generator generates an input signal as a function of the number of lamp filament connected to the filament control circuit. A current sensor generates a first voltage indicative of whether a lamp filament has been reconnected to the circuit. A peak detector generates a peak voltage signal when the first voltage indicates a reconnection of a lamp filament has occurred. A sensing circuit generates a command signal to provide to the control circuit to supply power to the filament control circuit to preheat and power the lamp when the peak detector generates the peak voltage signal.

14 Claims, 3 Drawing Sheets

BALLAST WITH RELAMPING CIRCUITRY

TECHNICAL FIELD

The present invention relates to ballasts for powering gas discharge lamps. In particular, the invention relates to an electronic ballast for powering multiple series-connected fluorescent lamps having filaments connected in parallel. The ballast includes relamping circuitry for detecting the reconnection of a lamp filament in order to energize the reconnected lamp.

BACKGROUND OF THE INVENTION

Electronic ballasts for gas discharge lamps are often classified into two groups according to how the lamps are ignited: (1) a preheat type ballast; and (2) an instant start type ballast. In preheat ballasts, the lamp filaments are preheated at a relatively high level (e.g., 7 volts peak) for a limited period of time (e.g., one second or less) before a moderately high voltage (e.g., 500 volts peak) is applied across the lamp in order to ignite the lamp. In instant start ballasts, the lamp filaments are not preheated, so a higher starting voltage (e.g., 1000 volts peak) is required in order to ignite the lamp. It is generally acknowledged that instant start operation offers certain advantages, such as the ability to ignite the lamp at a lower ambient temperatures and greater energy efficiency (i.e., light output per watt) due to no expenditure of power on filament heating during normal operation of the lamp. On the other hand, instant start operation usually results in considerably lower lamp life than preheat operation.

Because a significant amount of power can be unnecessarily expended heating the lamp filaments after the lamp is ignited, it is desirable to have preheat type ballasts in which filament power is minimized or eliminated once the lamp has ignited. One approach for preheating ballasts employs switching circuitry such as a filament control circuit that disconnects the source of filament power from each of the filaments after the lamp ignites. However, when such switching circuitry is used with ballasts driving multiple fluorescent lamps, there have been problems preheating and igniting lamps which have been disconnected from the ballast and then reconnected back to the ballast. One solution to ignite such reconnected lamps has been to cycle the power supplied to the ballast (i.e., turn the power off, and then back on).

In ballast circuits driving three (3) or more lamps, the outermost lamps are usually connected directly to the ballast circuit. Thus, disconnecting the outer lamps may cause an open circuit which can be detected. When an outer lamp is reconnected, it closes the circuit so that preheating and/or ignition can be initiated. However, the inner lamps, such as the middle lamp in a three lamp circuit, are connected with one or more of the outer lamps but are not directly connected to the ballast circuit. Hence, removing and reconnecting an inner lamp may not close an open circuit so that its reconnection is difficult to detect. Accordingly, re-igniting a disconnected and reconnected inner lamp has typically required cycling of the power. To avoid the need for cycling the ballast power when an inner lamp of a plurality of lamps connected to the ballast circuit is taken out and then reconnected to the circuit, there is a need for a ballast circuit that detects the reconnection of an inner lamp to preheat and/or ignite the reconnected lamp without requiring cycling of the power.

SUMMARY OF THE INVENTION

In accordance with one aspect of the invention, a ballast circuit is provided for detecting the reconnection of a lamp filament to a power bus in an electronic ballast driving a fluorescent lamp. The ballast circuit includes an inverter control circuit that controls an inverter circuit to provide power to the power bus. The ballast circuit also includes a filament control circuit that interconnects the power bus and the lamp filament to preheat and power the lamp filament and to inhibit the inverter circuit when sensing that the lamp filament has been disconnected from the filament control circuit. The ballast circuit also includes a pulse generating circuit coupled to the lamp filament that generates an input signal indicative of a reconnection of the lamp filament to the filament control circuit. The ballast circuit further includes a detection circuit coupled to the pulse generating circuit that detects the reconnection of the lamp filament and is operative to produce a command signal that is provided to the inverter control circuit to cause the inverter circuit to supply power to the filament control circuit to preheat the lamp filament and supply power to the lamp.

In accordance with another aspect of the invention, a detection circuit is provided for detecting the reconnection of a lamp filament in an electronic ballast that includes a filament control circuit for preheating and powering lamp filaments of a plurality of fluorescent lamps. The ballast includes an inverter control circuit that controls an inverter circuit to provide an AC voltage signal to power the filament control circuit to preheat and power each lamp filament of the plurality of lamps. The ballast also includes a pulse generating circuit coupled to the plurality of lamps to generate an input signal indicative of a reconnection of one of the lamp filaments to the filament control circuit. The ballast also includes a current sensor that is connected to the pulse generating circuit and responsive to the input signal for generating an input voltage signal that has a first magnitude when the filament is disconnected from the filament control circuit and has a second magnitude when the filament is reconnected to the filament control circuit. The ballast also includes a peak detection circuit connected to the current sensor that senses a magnitude of the input voltage signal, and generates a detected voltage signal as a function of the sensed magnitude of the input voltage signal. The detected voltage signal has a peak magnitude when the input voltage signal has the second magnitude. The ballast further includes a sensing circuit connected to the peak detection circuit that senses a magnitude of the detected voltage signal, and generates a command signal that is provided to the inverter control circuit to supplying power to the filament control circuit to preheat and power the lamp filament when the detected voltage signal has the peak magnitude.

In accordance with yet another aspect of the invention, a method is provided for detecting the reconnection of a lamp filament to a power bus in a ballast circuit driving a fluorescent lamp. The method includes supplying an alternating current (AC) signal to the lamp via an inverter circuit. The method also includes preheating and powering the lamp filament when the lamp filament is connected to the power bus. The method also includes generating an input signal that has a first magnitude when the lamp filament is disconnected from the power bus and has a second magnitude when the lamp filament is reconnected to the power bus. The method also includes generating a detection signal as a function of the magnitude of the generated input signal. The generated detection signal has a peak magnitude when the generated input signal has the second magnitude. The method further includes supplying the AC signal to preheat and power the lamp filament when the detection signal has the peak magnitude.

DETAILED DESCRIPTION OF THE PREFERRED EMBODIMENTS

Figure 1:
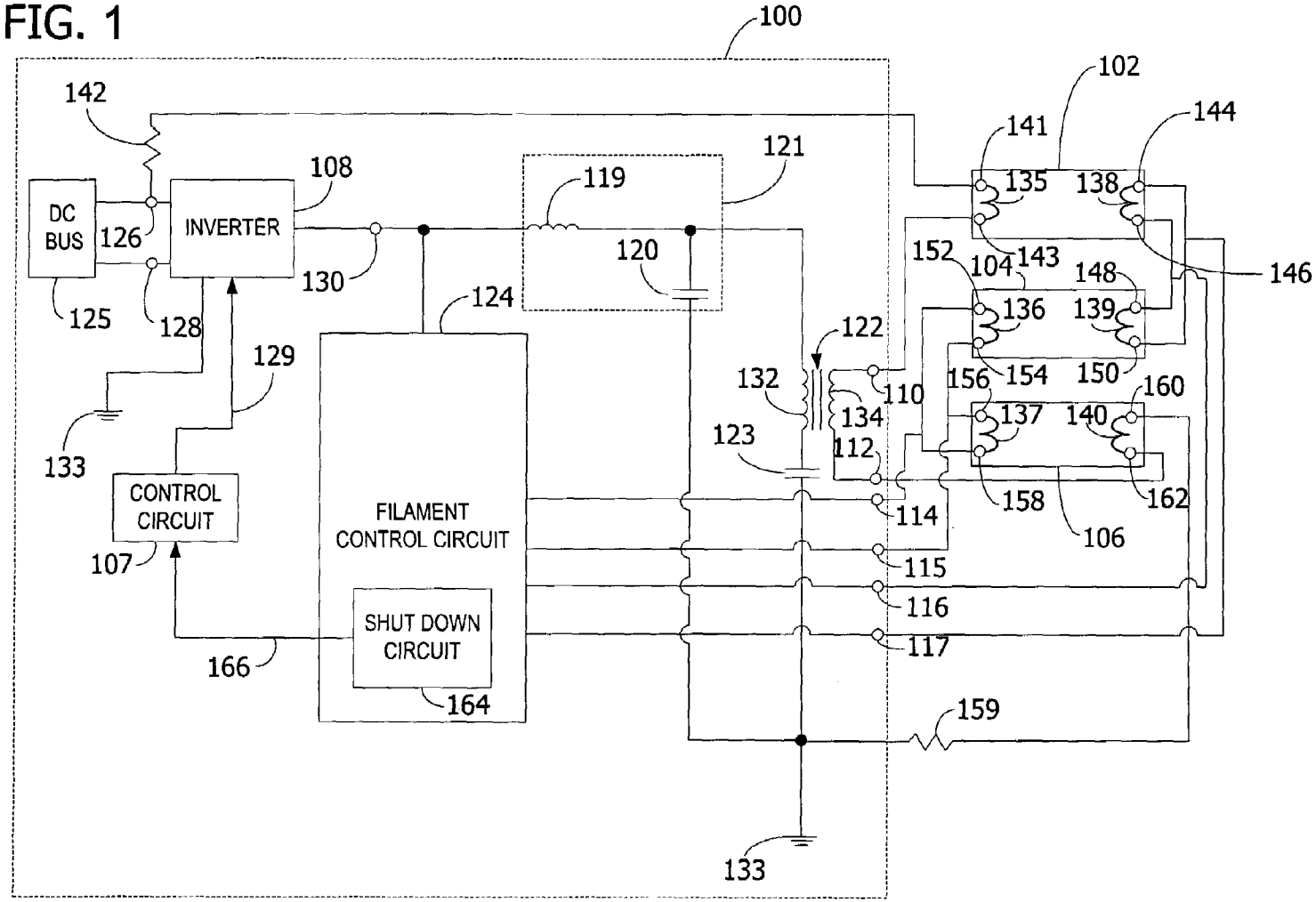
FIG. 1 is a block diagram illustrating a ballast circuit for powering a plurality of gas discharge lamps

FIG. 1 illustrates a ballast circuit 100 for powering a plurality of gas discharge lamps 102, 104, 106. The ballast circuit 100 includes a control circuit 107 connected to and controlling an inverter 108 to supply power to output terminals 110, 112, 114, 1.15, 116, 117 via an isolation transformer 122, and via a filament control circuit 124.

The inverter 108 receives a substantially direct current (DC) input voltage, $V_{DC}$, from a DC bus 125 via input terminals 126, 128, and is responsive to a control signal 129 from the control circuit 107 to provide an alternating current (AC) output voltage at output bus terminal 130 for powering the lamps 102, 104, 106. The DC input voltage can be provided from a DC source (not shown) such as a rectified input AC source, a battery, or any other source of DC power. As known to those skilled in the art, the AC output voltage at inverter output bus terminal 130 has a high frequency (e.g., 20,000 hertz or greater) at or near to the natural resonant frequency of an inductor 119 and a capacitor 120 of a resonant tank circuit 121 connected to the inverter 108, the isolation transformer 122, and circuit ground 133.

The isolation transformer 122 provides the increased voltage necessary for igniting the lamps 102, 104, 106 and minimizes power dissipation. The isolation transformer 122 includes a primary winding 132 connected between the inductor 119 and capacitor 120 and connected to circuit ground 133 via a DC blocking capacitor 123 such that the primary winding 132 and the DC blocking capacitor 123 form a series combination that is connected in parallel with the capacitor 120 of the resonant tank circuit 121. A secondary winding 134 of the isolation transformer 122 outputs the increased voltage via terminals 110, 112. More specifically, the isolation transformer 122 is responsive to the AC output voltage at bus terminal 130, and the resulting voltage across the capacitor 120, to provide an increased AC output voltage at the secondary winding 134 for preheating and/or igniting the lamps 102, 104, 106.

The filament control circuit 124 coupled to bus terminal 130 supplies a preheat voltage to lamps 102, 104, 106 via output terminals 114, 115, 116, 117 to preheat the filaments 135–140 of lamps 102, 104, 106. As explained above, in order minimize the amount of power expended on heating lamp filaments in a preheat ballast, it is desirable to preheat lamp filaments prior to ignition by supplying a preheat voltage during a preheat mode in which the voltage applied across each of the lamps is substantially less than an ignition voltage required to ignite the lamp. Output terminals 110, 112, 114, 115, 116, 117 and input terminal 126 are adapted for connection to the filaments 135–140 of the lamps 102, 104, 106. More specifically, input terminal 126 is connected to a connection 141 of a first filament 135 of lamp 102 via a current limiting resistor 142, and output terminal 110 is connected to a connection 143 of the first filament 135 of lamp 102. Output terminals 116, 117 are connected to a second filament 138 of lamp 102 via connections 144, 146, respectively, and to a second filament 139 of lamp 104 via connections 148, 150. Output terminals 114, 115 are connected to a first filament 136 of lamp 104 via connections 152, 154, and to a first filament 137 of lamp 106 via connections 156, 158. A second filament 140 of lamp 106 is connected to output terminal 112 via connection 162, and to circuit ground 133 via a current limiting resistor 159 and connection 160. Thus, as can be seen, the first filament 135 of lamp 102 is connected in series with output terminal 110 and input terminal 126 via resistor 142. The first filament 136 of lamp 104 is connected in parallel with the first filament 137 of lamp 106 via output terminals 114, 115. The second filament 138 of lamp 102 is connected in parallel with the second filament 139 of lamp 104 via output terminals 116, 117. The second filament 140 of lamp 106 is connected in series with the secondary winding 134 of the isolation transformer 122.

In this particular circuit 100, the filament control circuit 124 is configured to provide the preheat voltage to filaments 136–139. For example, the preheat voltage produced across output terminals 114, 115 preheats filaments 136 and 137 of the second and third lamps 104, 106, and the preheat voltage across output terminals 116, 117 preheats filaments 138 and 139 of the first and second lamps 102, 104. After filament preheat is complete, the filament control circuit 124 shuts down, and only re-activates when power to ballast circuit 100 is cycled.

In operation, when either of the outer lamps 102, 106 are removed an open circuit occurs between terminals 126 and 141 or between terminal 160 of the filament 140 of the outer lamp 106 and ground 133. This causes the voltage across the resistor 159 to fall to zero. When the outer lamps 102, 106 are reconnected, the circuit is closed. As such a voltage appears across the resistor 159 which can be used to re-trigger the control circuit 107 to start the ballast again. Notably, resistor 159 should be of sufficiently high value so that the isolation between the input and the output because of the presence of isolation transformer 122 remains substantially unaffected. However, as noted above, the filaments 136,139 of middle lamp 104 are connected in parallel with the filaments 137, 138 of lamps 106, 102, respectively. Because of this parallel connection, the control circuit 107 cannot detect an open circuit when lamp 104 is removed or a closed circuit when lamp 104 is reconnected. As explained in more detail below in reference to FIG. 2, the filament control circuit 124 includes a shut down circuit 164 responsive to the removal of the any of the three lamps to generate a fault signal 166. The control circuit 107 connected to the shut down circuit 164 is responsive to the fault signal 166 to shut down the inverter 108. As a result, minimal, if any, voltage is present across the primary and secondary windings 132, 134 of the isolation transformer 122, and, thus, the filament control circuit 124 is de-energized and shuts down. The middle lamp 104 becomes a floating system. That is, even when the middle lamp 104 is reconnected, the filament control circuit 124 remains deactivated until the ballast power is cycled.

Figure 2:
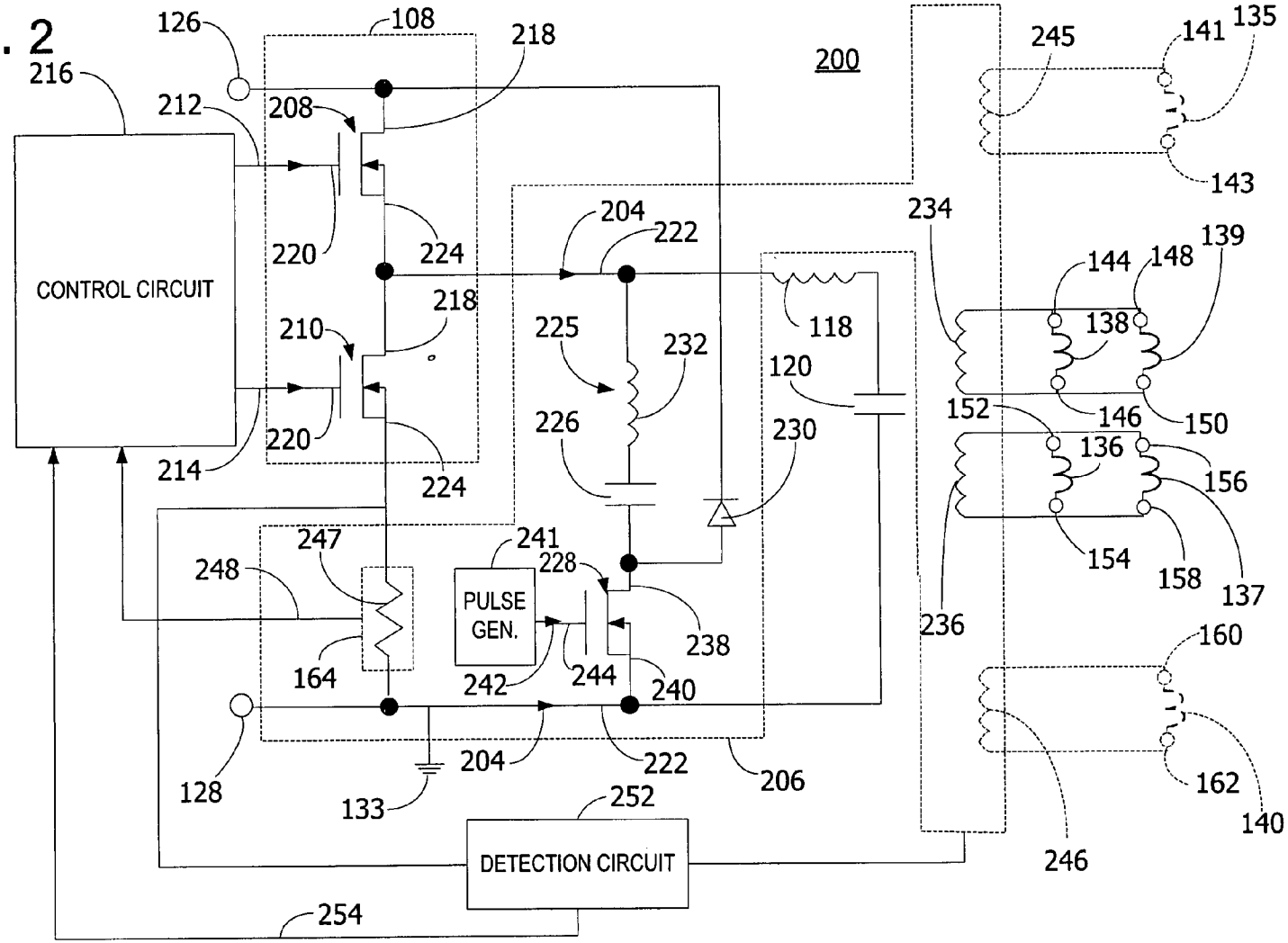
FIG. 2 is a combination block and schematic diagram illustrating components of a ballast circuit according to one embodiment of the invention.

Referring now to FIG. 2, a combination block and schematic diagram illustrates components of a ballast circuit 200 according to one embodiment of the invention. As described above, the inverter circuit 108 is responsive to an input DC voltage signal received via input terminal 126, 128 to generate an output AC voltage signal, as indicated by reference character 204, for powering the lamp filaments 135–140 via a filament control circuit 206 (e.g., filament control circuit 124 in FIG. 1). In this embodiment, the inverter circuit 108 includes switching transistors such as MOSFETs 208, 210, connected between DC input terminals 126, 128. MOSFETs 208, 210 are driven by first and second control signal 212, 214, respectively, supplied from a control circuit 216 (e.g., control circuit 107 in FIG. 1) to generate the output AC voltage signal 204. The control circuit 216 can be a L6569 Half Bridge Driver manufactured by STMicroelectronics of Plan les Ouates, Geneva, Switzerland.

A drain 218 of the MOSFET 208 is coupled to input terminal 126. A gate 220 of the MOSFET 208 connected to the control circuit 216 is responsive to the first control signal 212 generated by the control circuit 216 to turn the MOSFET 208 on and off. For example, when the magnitude of the first control signal 212 is equal to or greater than a threshold voltage (i.e., first control signal has at least a minimum magnitude), the MOSFET 208 turns on and positive current flows through the ballast circuit 200 via a power bus 222. A drain 218 of the MOSFET 210 is coupled to a source 224 of MOSFET 208. A gate 220 of the MOSFET 210 connected to the control circuit 216 is responsive to the second control signal 214 generated by the control circuit 216 to turn the MOSFET 210 on and off. For example, when the magnitude of the second control signal 214 is equal to or greater than a threshold voltage (i.e., second control signal has at least a minimum magnitude), the MOSFET 210 turns on and negative current flows through the circuit via power bus 222. By selectively activating MOSFETs 208, 210 in an alternating fashion, the control circuit 216 causes the inverter circuit 108 to generate the output AC signal to preheat, ignite and operate lamps 102, 104, 106.

As described above, the filament control circuit 206 provides a preheat voltage to the filaments 136–139 to preheat the lamps 102, 104, 106 prior to ignition. In this embodiment, the filament control circuit 206 includes a second transformer 225, a capacitor 226, a switching device 228 (e.g., a MOSFET), and a diode 230. The second transformer 225 has a primary winding 232, a first auxiliary winding 234, and a second auxiliary winding 236. The primary winding 232 is connected to the inverter circuit 108 and circuit ground 133, via capacitor 226 and the switching device 228, and is responsive to the output AC voltage signal 204 from inverter 108 to generate the preheat voltage across each of the first and second auxiliary windings 234 and 236. The MOSFET 228 is connected between the capacitor 226 and circuit ground 133. More specifically, a drain 238 of the MOSFET 228 is connected to capacitor 204 and a source 240 of the MOSFET 228 is connected to circuit ground 133. A pulse generator 241 supplies a pulse signal 242 to a gate 244 of the MOSFET 228 to turn the MOSFET 228 on and off. For example, the pulse generator 241 is configured to generate the pulse signal 242 when the DC input voltage between input terminals 126, 128 reaches a threshold value. When the pulse signal 242 is supplied to the gate 244 of the MOSFET 228, the MOSFET 228 turns on and current flows thru the primary winding 232 of the second transformer 224. As a result, current flows through each of the first and second auxiliary windings 234, 236 producing the preheat voltage across each of the first and second auxiliary windings 234, 236.

The filaments 138 and 139 of the first and second lamps 102, 104, respectively, are connected in parallel with each other, via connections 144, 146 and connections 148, 150, respectively, and with the first auxiliary winding 234. The filaments 136 and 137 of the second and third lamps 104, 106, respectively, are connected in parallel with each other, via connections 152, 154 and connections 156, 158, respectively, and with the second auxiliary winding 236. When the pulse signal 242 being applied to the gate 224 of MOSFET 228 is removed, the MOSFET 228 turns off and current stops flowing to the primary winding 232 of the second transformer 225, and, thus, no voltage is generated across the first and secondary auxiliary windings 234, 236. Notably, as illustrated in phantom lines, the filament control circuit 206 may also include third and fourth auxiliary windings 245, 246 for preheating the remaining filaments 135 and 140 of outer lamps 102, 106, respectively. However, for purposes of illustration the filament control circuit 108 is described herein as supplying a preheat voltage to filament 138 of outer lamp 102, to filament 137 of outer lamp 106, and to filaments 136, 139 of middle lamp 104.

The shut down circuit 164 includes a current sensing resistor 247, and generates a fault signal 248 representative of the voltage drop across the resistor 247. The control circuit 216 connected to the shutdown circuit 164 is responsive to the fault signal 248 (e.g., fault signal 166 in FIG. 1) having a magnitude greater than a specified value (e.g., 1V) to shut down the ballast 200. For example, as known to those skilled in the art, when any one of the lamps 102, 104, 106 is removed from the circuit 200, the MOSFETS 208, 210 go into hard switching. As a result, the current through the inverter 108 increases resulting in current spikes within the ballast circuit 200. These current spikes cause the voltage drop across resistor 247 to increase beyond the specified value. The control circuit 216 is responsive to the increased voltage to inhibit operation of the inverter circuit 108 by preventing control signals 212 and 214 (i.e., gate-drive signals for MOSFETs 208, 210) from being supplied to the inverter circuit 108. This terminates AC power from being supplied to the lamps 102, 104, 106.

According to the present invention, a detection circuit 252 connected to the filament control circuit 206 and the control circuit 216 is responsive to an input signal indicative of the reconnection of one or more lamps 102, 104, 106 to generate a command signal 254 provided to the control circuit 216 to override the fault signal 248 to operate the inverter 108 without cycling of the power to the ballast.

Figure 3:
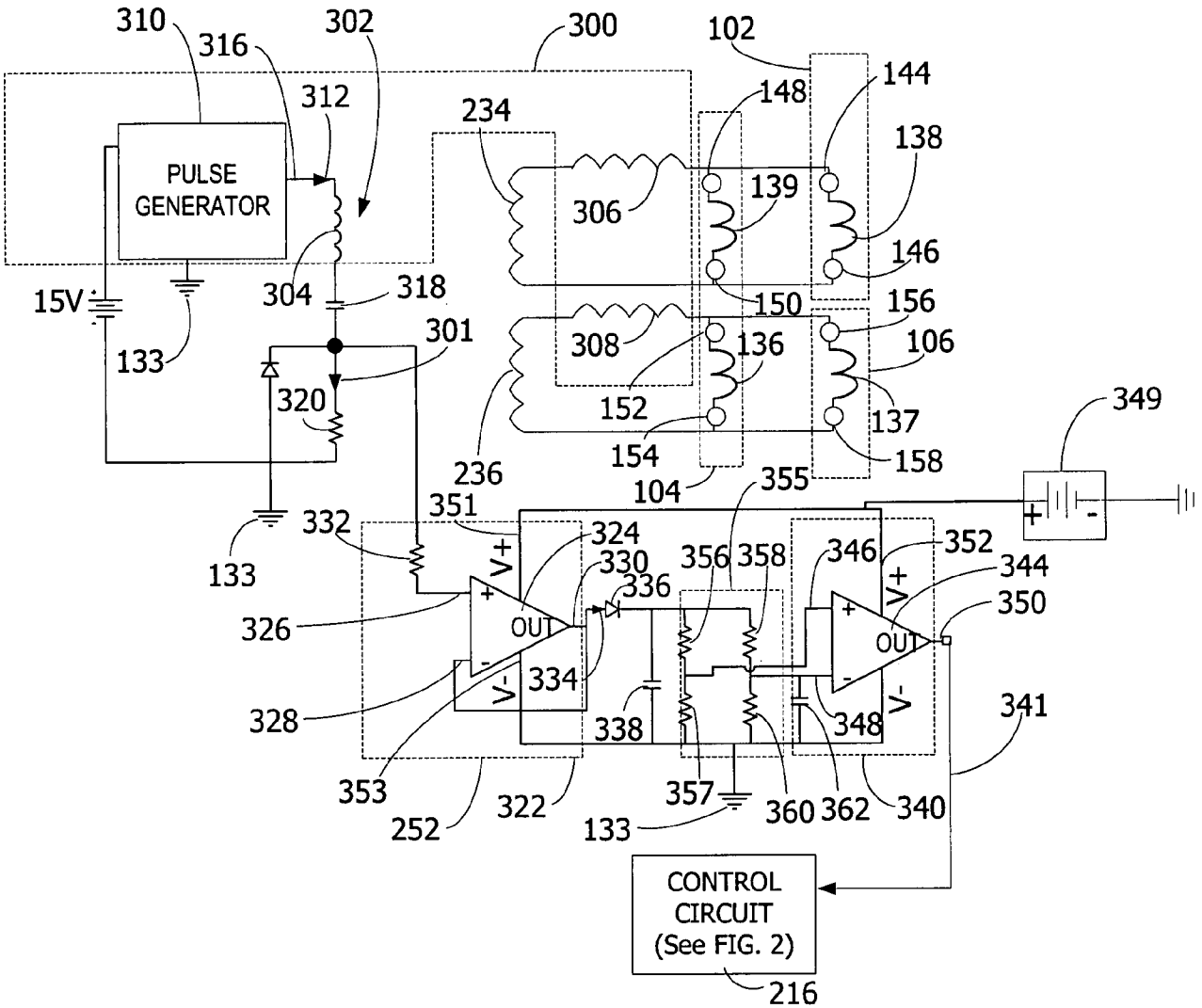
FIG. 3 illustrates components of a detection circuit for detecting the reconnection of a filament in the ballast according to one embodiment of the invention Corresponding reference characters indicate corresponding parts throughout the drawings.

Referring now to FIG. 3, a schematic diagram illustrates components of a detection circuit 252 of the ballast circuit 200 for detecting the disconnection and reconnection of any of lamps 102, 104, 106 according to one embodiment of the invention. In this particular embodiment, the detection circuit 252 senses a magnitude of an input voltage signal generated within the ballast circuit 200 and generates the command signal 254 provided to the control circuit 216 as a function of the magnitude of the sensed voltage.

A pulse generating circuit 300 connected to the filament control circuit 206 and the lamps 102, 104, 106 generates an input signal, as indicated by reference character 301, indicative of a disconnection or reconnection of a lamp filament from the filament control circuit 206. The pulse generating circuit 300 includes a pulse transformer 302, having a primary winding 304 and first and second auxiliary windings 306, 308. The primary winding 304 is connected to a second pulse generator 310 supplying a pulse signal 312 of high frequency. The pulse transformer 302 is responsive to the pulse signal 312 supplied to the primary winding 304 to generate an output voltage across each of the first and second auxiliary windings 306, 308. The pulse generator 310 is, for example, an astable multivibrator 555 timer capable of providing a high frequency voltage signal. The first and second auxiliary windings 306, 308 of the pulse transformer 302 are connected in series with the first and second auxiliary windings 234, 236, respectively, of the filament control circuit 206 (see FIG. 2). As a result of the output voltage signal generated across the first and second auxiliary windings 306, 308, a current is continuously supplied to filaments 138 and 139 of the first and second lamps 102, 104 and to filaments 136 and 137 of the second and third lamps 104, 106. As known to those skilled in the art, when a circuit includes resistive elements (e.g., filaments) connected in parallel, and one of the resistive elements is removed, the effective resistance of the circuit increases. From FIG. 3 it can be seen that the filament 138 of lamp 102 is connected in parallel with the filament 139 of lamp 104. Accordingly, if filament 139 of lamp 104 is disconnected, the current through first auxiliary winding 306 of pulse transformer 302 is reduced because the corresponding effective resistance on the secondary side increases. When the second filament 139 of lamp 104 is reconnected, the corresponding effective resistance on the secondary side decreases, and, thus, current through the first auxiliary winding 306 increases.

As a result of the current supplied to the first and/or second auxiliary windings 306, 308, there is a reflected current (e.g., input signal 301) in the primary winding 304. The primary winding 304 of the pulse transformer 302 is connected to output terminal 316 of the pulse generator 310 and circuit ground 133 via a filtering capacitor 318 and a current sensing resistor 320 (e.g., current sensing resistor 247 of FIG. 2). Thus, the magnitude of the current flowing through the resistor 320 corresponds to the number of filaments connected to the filament control circuit 206. For example, if the filament 139 of lamp 104 is disconnected, the current through resistor 320 is reduced, and, thus, the voltage drop across resistor 320 decreases. When the filament 139 of lamp 104 is reconnected, the reflected current onto the primary winding 304 increases resulting in an increased voltage drop across the current sensing resistor 320.

A peak detector circuit 322 connected to the current sensing resistor 320 detects when the voltage drop across the current sensing resistor 320 increases. In this embodiment, the peak detector 322 includes a first operational amplifier (opamp) 324 having a first input terminal (non-inverting terminal) 326, a second input terminal 328 (inverting terminal), and an output terminal 330. The non-inverting terminal 326 is connected to the filtering capacitor 318 and the current sensing resistor 320 via an input resistor 332. The inverting terminal 328 is tied to the output terminal 330 so that the first opamp 324 acts as a voltage follower. Thus, the first opamp 324 receives an input voltage at the non-inverting terminal 326 determined as a function of the magnitude of the voltage drop across the current sensing resistor 320, and is responsive to the input voltage at the non-inverting input terminal 326 to generate an output voltage signal $V_{out}$, as indicated by reference character 334. In other words, the output voltage signal 334 follows the voltage across the current sensing resistor 320. A diode 336 connected to the output terminal 330 is forward biased by the output voltage signal 334 and charges a capacitor 338. The capacitor 338 continues to charge until the inverting and non-inverting terminals are at same voltage. In other words, when the voltage at the non-inverting input terminal 326 exceeds the voltage at the inverting input terminal 328, the capacitor 338 continues to charge until the voltage across the capacitor 338 is equal to the input voltage at the non-inverting input terminal 326. Because the output voltage signal 334 follows the voltage across the current sensing resistor 320, the voltage across capacitor 338 decreases when a filament is removed and increases (i.e., peaks) when a filament is connected.

A sensing circuit 340 connected to the peak detection circuit 322 is responsive to the output voltage signal 334 to generate a command signal 341 (e.g., command signal 254 of FIG. 2) provided to the control circuit 216 to control operation of the inverter circuit 108. The sensing circuit 340 includes a second operational amplifier (opamp) 344 having a first input terminal (non-inverting terminal) 346, a second input terminal 348 (inverting terminal), and an output terminal 350. In this particular embodiment, the first and second opamps 324, 344 include positive voltage input terminals 351, 352, respectively, that are tied together and connected to a DC voltage source 349 (e.g., 15 volt DC source), and negative voltage input terminals 353, 354 that are both connected to ground 133. The non-inverting terminal 346 is connected to the peak detector 322 via a resistor network 355. The resistor network 355 comprises resistors 356, 357 connected in series with each other and connected in parallel with resistors 358, 360. The values of the resistors 356, 357, 358, 360 in the resistor network 348 determine the input voltages supplied to the non-inverting terminal 346 and the inverting terminal 348. The inverting terminal 344 is connected to the peak detector 322 via the resistor network 355, and a delay capacitor 362 connected in parallel with resistor 360. The non-inverting terminal 346 and the inverting terminal 348 are connected to the resistor network 355 such that the effective resistance ultimately causes input voltage at the inverting terminal 348 to be greater than the input voltage at the non-inverting terminal 346. However, the inverting terminal 348 is also connected to the capacitor 362, which operates to delay this condition. That is, the delay capacitor 362 slowly charges so that the input voltage at the non-inverting terminal 346 is initially greater than the input voltage at the inverting terminal 348, and the opamp 316 is responsive to the voltage difference to generate an output voltage signal, as indicated by 341, having a peak magnitude (e.g., 5 volts), which is indicative of the reconnection of a filament. After a delay, the capacitor 362 charges so that the input voltage at the inverting terminal 348 becomes greater than the input voltage at the non-inverting terminal 346, at which time the output voltage signal 341 (i.e., command signal) goes low (e.g., 0 volts). Thus, in operation the command signal 341 generated by the sensing circuit 340 can have two different states. For example, when the detection signal has a peak magnitude (i.e., filament connected), the command signal 341 generated by the sensing circuit 340 has a first state (e.g., peak magnitude). In contrast, when the detection signal has a minimum magnitude (i.e., filament disconnected), the command signal 341 generated by the sensing circuit 340 has a second state (e.g., low magnitude). The control circuit 112 is responsive to the command signal 341 having a peak magnitude to activate the MOSFETs 208, 210 (See FIG. 2) to supply power to the lamps 102, 104, 106. Notably, it can be seen that after implementation of this circuit 200, resistors 142 and 159 (see FIG. 1), which can be used to detect the removal of the outer lamps 102, 106 can be eliminated from the circuit. That is, because the outer lamp filaments 137, 138 are connected in parallel with the middle lamp filaments 136, 139, respectively, the re-lamping of the outer lamps 102, 106 will also get detected in the same way as re-lamping of the middle lamp.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

I claim:

1. A circuit for detecting the reconnection of a lamp filament to a power bus in an electronic ballast driving a fluorescent lamp, said circuit comprising:

an inverter control circuit for controlling an inverter circuit providing power to the power bus;

a filament control circuit interconnecting the power bus and the lamp filament for preheating and powering the lamp filament and for inhibiting the inverter circuit when sensing that the lamp filament has been disconnected from the filament control circuit;

a pulse generating circuit coupled to the lamp filament for generating an input signal indicative of a reconnection of the lamp filament to the filament control circuit;

a detection circuit coupled to the pulse generating circuit for detecting the reconnection of the lamp filament and operative to produce a command signal provided to the inverter control circuit to cause the inverter circuit to supply power to the filament control circuit to preheat the lamp filament and supply power to the lamp; and wherein the pulse generating circuit comprises:

a pulse generator supplying a control signal; and a transformer having a primary winding receiving the control signal and a secondary winding connected to the lamp filament, wherein the control signal at the primary winding corresponds to an output pulse signal at the secondary winding, said output pulse signal having an output current having a first magnitude when the lamp filament is disconnected from the filament control circuit, and having a second magnitude when the lamp filament is reconnected to the filament control circuit, and wherein the output current signal generated at the secondary winding corresponds to an input current signal at the primary winding, said input current signal having a peak magnitude when the output current signal has the second magnitude.

2. A circuit for detecting the reconnection of a lamp filament to a power bus in an electronic ballast driving a fluorescent lamp, said circuit comprising:

an inverter control circuit for controlling an inverter circuit providing power to the power bus;

a filament control circuit interconnecting the power bus and the lamp filament for preheating and powering the lamp filament and for inhibiting the inverter circuit when sensing that the lamp filament has been disconnected from the filament control circuit;

a pulse generating circuit coupled to the lamp filament for generating an input signal indicative of a reconnection of the lamp filament to the filament control circuit;

a detection circuit coupled to the pulse generating circuit for detecting the reconnection of the lamp filament and operative to produce a command signal provided to the inverter control circuit to cause the inverter circuit to supply power to the filament control circuit to preheat the lamp filament and supply power to the lamp; and wherein the detection circuit comprises:

a peak detection circuit connected to the pulse generating circuit for sensing a magnitude of the generated input signal, and generating a detection signal as a function of the sensed magnitude of the generated input signal; and a sensing circuit connected to the peak detection circuit for sensing a magnitude of the detection signal, and generating the command signal provided to the inverter control circuit for supplying power to the filament control circuit to preheat and power the lamp when the magnitude of the detection signal is indicative of a reconnection of the lamp filament to the filament control circuit.

3. The circuit of claim 2, wherein the sensing circuit generates a command signal having a first state when the detection signal has a peak magnitude, and generates a command signal having a second state when the detection signal has a minimum magnitude, and wherein the inverter control circuit is responsive to the command signal having the first state to provide power to filament control circuit to preheat and power the lamp filament.

4. The circuit of claim 2, wherein the detection circuit further comprises a current sensor connected to the pulse generating circuit, wherein the current sensor is responsive to the generated input signal to generate an input voltage signal, and wherein the input voltage signal has a first magnitude when the filament is disconnected from the filament control circuit and has a second magnitude when the filament is reconnected to the filament control circuit.

5. The circuit of claim 4, wherein the peak detection circuit includes a first operational amplifier having first and second input terminals and an output terminal, wherein the first input terminal is connected to the current sensor for receiving the input voltage signal, and wherein the second input terminal is connected to the output terminal, and wherein said first operating amplifier generates the detection signal having a peak magnitude when the input voltage signal has the second magnitude.

6. The circuit of claim 5, wherein the sensing circuit includes a second operational amplifier having first and second input terminals, wherein the first input terminal is connected to the output terminal of the first operational amplifier for receiving the detection signal via a resistor network, and the second input terminal is connected to the output terminal of the first operational amplifier for receiving the detection signal via the resistor network and a delay capacitor, and wherein said second operating amplifier generates the command signal having the first state when the detection signal has the peak magnitude.

7. A circuit for detecting the reconnection of a lamp filament to a power bus in an electronic ballast driving a fluorescent lamp, said circuit comprising:

an inverter control circuit for controlling an inverter circuit providing power to the power bus;

a filament control circuit interconnecting the power bus and the lamp filament for preheating and powering the lamp filament and for inhibiting the inverter circuit when sensing that the lamp filament has been disconnected from the filament control circuit;

a pulse generating circuit coupled to the lamp filament for generating an input signal indicative of a reconnection of the lamp filament to the filament control circuit;

a detection circuit coupled to the pulse generating circuit for detecting the reconnection of the lamp filament and operative to produce a command signal provided to the inverter control circuit to cause the inverter circuit to supply power to the filament control circuit to preheat the lamp filament and supply power to the lamp; and wherein the filament control circuit includes a shut down circuit coupled to the inverter control circuit for generating a fault signal indicative of a disconnection of the lamp filament from the filament control circuit, and wherein the inverter control circuit is responsive to the fault signal for inhibiting the inverter control circuit from providing power to the power bus.

8. The circuit of claim 7, wherein the detection circuit is responsive to an input signal indicative of the reconnection of the lamp filament to generate a command signal provided to the inverter control circuit for overriding the fault signal to cause the inverter circuit to supply power to the power bus without power recycle.

9. A detection circuit for detecting the reconnection of a lamp filament in an electronic ballast having a filament control circuit for preheating and powering lamp filaments of a plurality of fluorescent lamps, said circuit comprising:

an inverter control circuit for controlling an inverter circuit to provide an AC voltage signal to power the filament control circuit for preheating and powering each lamp filament of the plurality of lamps;

a pulse generating circuit coupled to the plurality of lamps for generating an input signal indicative of a reconnection of one of the lamp filaments to the filament control circuit;

a current sensor connected to the pulse generating circuit and responsive to the input signal for generating an input voltage signal having a first magnitude when the filament is disconnected from the filament control circuit and having a second magnitude when the filament is reconnected to the filament control circuit;

a peak detection circuit connected to the current sensor for sensing a magnitude of the input voltage signal, and generating a detected voltage signal as a function of the sensed magnitude of the input voltage signal, wherein the detected voltage signal has a peak magnitude when the input voltage signal has the second magnitude; and a sensing circuit connected to the peak detection circuit for sensing a magnitude of the detected voltage signal, and generating a command signal provided to the inverter control circuit for supplying power to the filament control circuit to preheat and power the lamp filament when the detected voltage signal has the peak magnitude.

10. The detection circuit of claim 9, wherein the sensing circuit generates a command signal having a first state when the detected voltage signal has the peak magnitude, and generates a command signal having a second state when the detected voltage signal has a minimum magnitude, and wherein the inverter control circuit is responsive to the command signal having the first state to provide power to filament control circuit to preheat and power the lamp filament.

11. The detection circuit of claim 9, wherein the peak detection circuit includes a first operational amplifier having first and second input terminals and an output terminal, wherein the first input terminal is connected to the current sensor for receiving the input voltage signal and the second input terminal is connected to the output terminal, and wherein said first operating amplifier generates, at the output terminal, the detected voltage signal having a peak magnitude when input voltage signal has the second magnitude.

12. The detection circuit of claim 11, wherein the sensing circuit includes a second operational amplifier having first and second input terminals, wherein the first input terminal is connected to the output terminal of the first operational amplifier for receiving the detected voltage signal via a resistor network and the second input terminal is connected to the output terminal of the first operational amplifier for receiving the detected voltage signal via the resistor network and a delay capacitor, and wherein said second operating amplifier generates the command signal having the first state when the detected voltage signal has the peak magnitude.

13. The detection circuit of claim 9 further comprising a shut down circuit coupled to the inverter control circuit and the lamp filament for generating a fault signal indicative of a disconnection of one of the lamp filaments from the filament control circuit, wherein the inverter control circuit is responsive to the fault signal for inhibiting the inverter control circuit from providing the AC voltage signal to power the filament control circuit.

14. The detection circuit of claim 13, wherein the detection circuit is responsive to an input signal indicative of the reconnection of the lamp filament to generate a command signal provided to the inverter control circuit for overriding the fault signal to cause the inverter circuit to supply the AC voltage signal to the filament control circuit without power recycle.

* * * * *